United States Patent [19]

Bachot et al.

[11] Patent Number: 4,919,772

[45] Date of Patent: Apr. 24, 1990

[54] ELECTROLYTIC CELL/PROCESS FOR THE REDUCTION OF TITANIUM/IRON SOLUTIONS

[75] Inventors: Jean Bachot, Bourg/La/Reine; Olivier Le Roux, Paris, both of France

[73] Assignee: Rhone-Poulenc Chimie, Courbevoie, France

[21] Appl. No.: 194,165

[22] Filed: May 16, 1988

[30] Foreign Application Priority Data

May 15, 1987 [FR] France ..... 87 06818

[51] Int. Cl.[5] ..... C25C 1/00; C25C 1/06

[52] U.S. Cl. ..... 204/96; 204/105 R; 204/112; 204/252; 204/290 R; 204/290 F; 204/292; 204/293

[58] Field of Search ..... 204/96, 105 R, 112, 204/252, 290 R, 290 F, 292, 293, 296

[56] References Cited

U.S. PATENT DOCUMENTS

| | | | |
|---|---|---|---|
| 4,113,726 | 1/1979 | Wagenknecht et al. | 204/72 |
| 4,175,014 | 11/1979 | Crnojevich et al. | 704/130 |
| 4,206,021 | 6/1980 | Rivori | 204/96 |
| 4,230,542 | 10/1980 | Traini et al. | 204/93 |
| 4,530,745 | 7/1985 | Komatsu et al. | 204/43 |

FOREIGN PATENT DOCUMENTS

| | | | |
|---|---|---|---|
| 2363642 | 9/1977 | France . | |
| 59-1688 | 1/1984 | Japan . | |
| 0996523 | 2/1983 | U.S.S.R. | 204/290 R |
| 1217927 | 6/1984 | U.S.S.R. . | |

OTHER PUBLICATIONS

Chem. Abstract 100:19988g, Electrochemical Reduction of Ferric Salts, Asahi Glass Co., Ltd.

*Primary Examiner*—John F. Niebling
*Assistant Examiner*—Kathryn Gorgos
*Attorney, Agent, or Firm*—Burns, Doane, Swecker & Mathis

[57] ABSTRACT

An electrolytic cell for the reduction of solutions containing both titanium and iron ions, e.g., solutions emanating from the sulfuric acidulation of ilmenite, has a cationic exchange membrane separating the anode and cathode compartments thereof; the solutions to be reduced are circulated within the cathode compartment of said electrolytic cell.

18 Claims, 1 Drawing Sheet

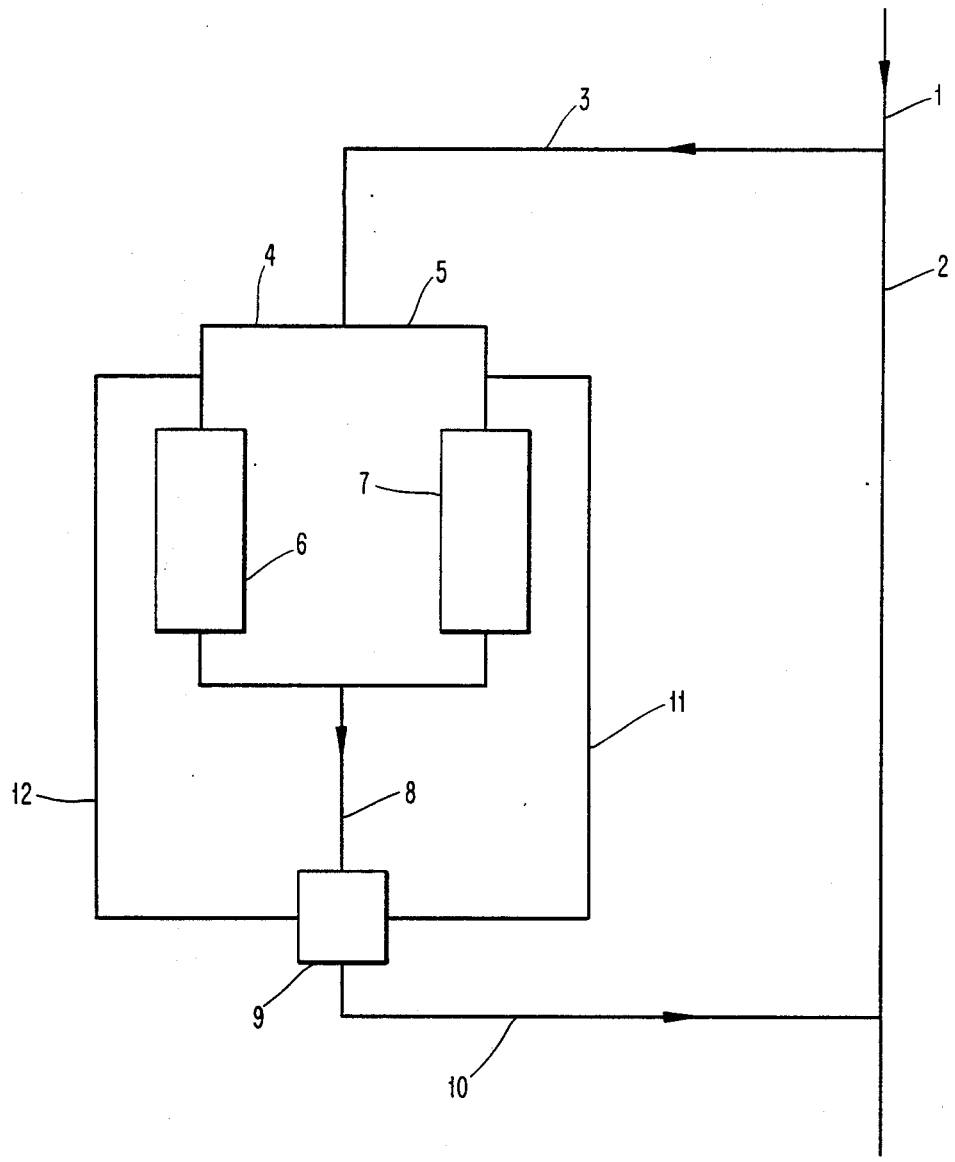
1
2
3
4
5
6
7
8
9
10
11
12

ELECTROLYTIC CELL/PROCESS FOR THE REDUCTION OF TITANIUM/IRON SOLUTIONS

BACKGROUND OF THE INVENTION

1. Field of the Invention

The present invention relates to an electrolytic cell and to a process for the electrolytic reduction of a solution containing both titanium and iron values, and., more especially, to the electrolytic reduction of a solution emanating from the sulfuric acid decomposition of ilmenite.

2. Description of the Prior Art

It is known to this art that the production of titanium dioxide entails acidulating a titanium bearing mineral of ilmenite type, whether anatase or rutile, with a sulfuric acid solution. Following this acid attack, a solution containing titanyl sulfate and the sulfates of ferric and ferrous iron are obtained, in particular.

This solution must be reduced in order to convert the ferric ions into ferrous ions, as the presence of ferric ions must be avoided during the subsequent stage of hydrolysis of the titanyl sulfate.

Several techniques are also known to this art for such reduction of ferric iron. Industrially, it is carried out using "scrap iron".

This method has several disadvantages. In particular, it is discontinuous. On the other hand, it requires the subsequent separation of large amounts of iron which yield, notably, chips of ferrous sulfate.

Electrochemical reductions too have been proposed. One of these methods is specifically described in published French Application No. 2,363,642.

However, the different types of electrolyzers heretofore used do not enable the realization of good yields at high current densities, densities of at least 10 A/dm$^2$.

SUMMARY OF THE INVENTION

Accordingly, a major object of the present invention is the provision of an improved electrolytic cell/process for the reduction of solutions containing both titanium and iron values using high current densities and obtaining desired final product in high yields.

Briefly, the electrolytic cell according to this invention for the reduction of a solution containing both titanium and iron ions is of the type comprising an anode compartment, a cathode compartment and an ion exchange membrane separating the two compartments, said membrane characteristically being a cationic membrane.

The process according to the invention comprises circulating said solution in the cathode department of the aforedescribed cell.

BRIEF DESCRIPTION OF THE DRAWING

The Figure of Drawing is a schematic/diagrammatic illustration of suitable electrolytic cell/process according to this invention.

DETAILED DESCRIPTION OF THE PREFERRED EMBODIMENTS OF THE INVENTION

More particularly according to the present invention, the subject electrolytic cell comprises two compartments, an anode and a cathode department, separated by an ion exchange membrane.

As a principal characteristic of the invention, this membrane is of the cationic type, in particular having strong acid groups, for example of the sulfonic type. Exemplary membranes of this type are those commercially available under the trademarks NAFION and SELEMION.

The use of a cationic membrane affords a certain number of advantages related to the properties of the membrane proper. In effect, their higher strength, compared to that of anionic membranes, renders the cell less fragile. It is also possible to operate the cell using higher current intensities.

Concerning the electrodes, the cathode may be based on a variety of materials.

In a preferred embodiment of the invention, a cathode based on copper is used, as this type of cathode provides the highest faradic yields due to the excellent mass transfer afforded by this material.

However, it is also possible to employ a cathode based on at least one material selected from among lead, titanium or specialty steels.

In the latter case, it is more particularly possible to use either lead or titanium by themselves, or lead supported on a suitable substrate, for example lead on titanium or lead on copper, or titanium coated with at least one precious metal.

Representative precious metals are platinum, iridium, palladium and, for example, a titanium cathode coated with 0.2% palladium.

Exemplary specialty steels are those of Uranus B 6 and Incoloy 825 type, i.e., steels containing chromium, nickel and molybdenum. However, their molybdenum content typically should not exceed approximately 15%.

Concerning the anode, its nature is not critical, provided that it has adequate resistance during the oxidation of water in an acid medium. In general, titanium coated with a precious metal, such as defined above, is used.

The electrodes may be in different shapes, for example flat, perforated, expanded, etc.

The membrane may be secured, resting on the anode. Turbulence promoters may be provided in the compartments of the cell.

The process of using the subject electrolytic cell will now be described in detail.

The process entails circulating the solution to be reduced in the cathode department of the aforedescribed electrolytic cell.

This solution contains titanium and iron ions. The titanium is present essentially in the form of titanium (IV), with the Fe(II)/Fe(III) ratio being variable.

The solution may also contain $H^+$ ions and anions of the sulfate type.

It will be appreciated that the basic process for the production of titanium dioxide essentially comprises the following stages:

The first stage comprises an acid attack on the titanium bearing mineral by a sulfuric acid solution. The decomposition solution obtained in this manner is reduced in a second stage, then clarified in a third stage. The stages 2 and 3 may be reversed. A fourth stage entails crystallizing and then separating a fraction of the ferrous sulfate in solution. The solution obtained in this fashion is concentrated in a fifth stage and, in a sixth stage, the hydrolysis of titanyl sulfate and the separation of the titanium hydroxide is carried out, the resulting product then being calcined.

The cell and the process of the invention are applicable, more particularly, to the reduction of the solution originating from the aforementioned first stage, i.e., the sulfuric acid decomposition of a titanium bearing mineral specifically of the ilmenite type.

It will also be appreciated that in such a case the reduction stage of the process (second stage) is carried out entirely by electrolysis.

However, it is also possible to conduct the reduction at any point in the process for the production of $TiO_2$between the decomposition and the hydrolysis, and in particular immediately prior to the hydrolysis.

In the anode compartment, either acidified water, for example, a 0.5N solution of $H_2SO_4$, or a solution of a ferrous salt, may be circulated.

It is apparent that the solution circulating in the cathode compartment may be recirculated from the outlet of said compartment.

It is also possible to circulate the solution in the cathode compartments of two cells mounted in parallel. Such an installation assures the constant operation of the production unit, even in the case of the failure of one of the cells.

In another preferred embodiment of the invention, the solution to be treated is separated into a first and a second part, the second part being treated by passing the same through the cathode compartment of the aforementioned cell. The solution treated in this manner is stored in reserve, and the solution issuing from this reserve is combined with said first part.

This particular embodiment is illustrated in the single Figure of Drawing.

The solution to be treated inlets at 1, a principal first part 2 continues in the process, while a second part 3 is subjected to the electrolytic treatment.

The flow 3 is divided into two parts 4 and 5 and feeds into the cathodic compartments of the two cells 6 and 7 mounted in parallel according to the invention. The two parts of this same flowstream are combined at the outlet 8 and open into a reservoir 9.

The flow 2 is rejoined by means of a conduit 10.

The conduits 12 and 11 make it possible to recycle at least part of the solution issuing from the reservoir 9 into the cathode compartment or compartments of at least one of the cells 6 and 7.

Such a system having a reservoir and two cells imparts a greater stability to the operation of the cells, even in the case of the instability of the Fe(II)/Fe(III) ratio in the principal flowstream. It is also possible by virtue of this system to treat only a fraction of the principal flow to the extent that the reduction of titanium has been carried far enough, for example on the order of 100 g/1.

In order to further illustrate the present invention and the advantages thereof, the following specific examples are given, it being understood that same are intended only as illustrative and in nowise limitative.

EXAMPLE 1

An electrolytic cell having the following characteristics was used, operating under the following conditions:

(i) Cationic membrane: NAFION 423;
(ii) Anode: expanded titanium coated with platinum-/iridium;
(iii) Cathode: expanded copper;
(iv) Current density: 30 A/dm$^2$.

The following media were circulated:

(a) Anolyte: 0.5 N $H_2SO_4$;
(b) Catholyte at inlet: $Ti^{4+}$120 g/l; $Fe^{2+}$45 g/l; $fe^{3+}$3 g/l; $H_2SO_4$ 270 g/l.

With a speed of circulation of the catholyte of 10 cm/s and of the anolyte of 0.5 cm/s, at a cell temperature of 65° C., a catholyte having the following composition was obtained at the outlet of the cathode compartment:

$Ti^{4+}$104 g/l; $Fe^{2+}$48 g/l; $Ti^{3+}$16 g/l.

The cathodic faradic yield was 99%.

EXAMPLE 2

The operating conditions were as follows:

An electrolytic cell having the following characteristics was used under the following conditions:

(i) Cationic membrane: NAFION 423;
(ii) Anode: expanded titanium with platinum/iridium;
(iii) Cathode: palladium coated, perforated titanium;
(iv) Current density: 20 A/dm$^2$.

The following media were circulated:

(a) Anolyte: 0.5 N $H_2SO_4$;
(b) Catholyte at the inlet: $Ti^{4+}$120 g/l; $Fe^{2+}$47 g/l; $Fe^{3+}$4 g/l; $H_2SO_4$ 270 g/l.

With a speed of circulation of the anolyte of 0.5 cm/s and of the catholyte of 10 cm/s, at a cell temperature of 65° C., a catholyte having the following composition was obtained at the outlet of the cathode compartment: $Ti^{4+}$113 g/l; $Fe^{2+}$51 g/l; $Ti^{3+}$7 g/l; the cathode faradic yield was 99%.

EXAMPLE 3

In this example, different types of cathodes were used in the Experiments 1, 2 and 3.

The operating conditions of the cell were the following:

(i) Catholyte at inlet: $Ti^{4+}$120 g/l; $Fe^{2+}$46 g/l; $Fe^{3+}$3 g/l; $H_2SO_4$ 270 g/l;
(ii) Speed of circulation of the catholyte: 30 cm/s:
(iii) Cell temperature: 65° C.;
(iv) Cationic membrane: NAFION 423;
(v) Current density: 30 A/dm$^2$;
(vi) Anolyte: 0.5 N $H_2SO_4$ in Experiments 3 and 2; a ferrous salt solution, $Fe^{2+}$40 g/l, in Experiment 3;
(vii) Anode: expanded titanium coated with platinum-/iridium in Experiments 3 and 2; and graphite in Experiment 3.

The results are reported below:

| EXPERIMENT | CATHODE | CATHODIC FARADIC YIELD (%) |
|---|---|---|
| 1 | graphite | 73 |
| 2 | perforated titanium | 84 |
| 3 | perforated copper | 99 |

EXAMPLE 4

This example demonstrates using the cell according to the invention to produce solutions highly concentrated in $Ti^{3+}$.

The operating conditions of the cell were as follows:

(i) Anolyte: $H_2SO_4$, 0.5 N;
(ii) Inlet catholyte: $Ti^{4+}$120 g/l; $Fe^{2+}$45.7 g/l; $Fe^{3+}$3.4 g/l; $H_2SO_4$ 270 g/l;
(iii) Speed of circulation of the catholyte: 60 cm/s;
(iv) Speed of circulation of the anolyte: 0.5 cm/s;
(v) Cell temperature: 65° C.;
(vi) Cationic membrane: NAFION 423;

(vii) Anode: expanded titanium, platinum/iridium coated;
(viii) Cathode: perforated copper;
(ix) Current density: 17 A/dm$^2$.

At the outlet, a catholyte having the following composition was obtained:

$Ti^{4+}$46.4 g/l; $Fe^{2+}$49.1 g/l; $Ti^{3+}$73.6 g/l.

The cathodic faradic yield was 97.5%.

EXAMPLE 5

An electrolytic cell was used having characteristics and conditions given below:

(i) Cationic membrane: NAFION 423;
(ii) Anode: expanded titanium coated with platinum-/iridium;
(iii) Cathode: lead;
(iv) Current density: 20 A/dm$^2$.

Further, the following media were circulated in the
(a) Anolyte: 0.5 N $H_2SO_4$;
(b) Catholyte at inlet: $Ti^{4+}$120 g/l; $Fe^{2+}$45 g/l; $Ti^{3+}$1 g/l; $H_2SO_4$ 270 g/l.

With a speed of circulation of the catholyte of 10 cm/s and of the anolyte of 0.5 ccm/s, at a temperature of the cell of 65° C., a catholyte having the following composition was obtained at the outlet of the cathode compartment:

$Ti^{4+}$104 g/l; $Fe^{2+}$48 g/l; $Ti^{3+}$8 g/l.

The cathodic faradic yield was 80%.

EXAMPLE 6

An electrolytic cell having the following characteristics and conditions was used:

(i) Cationic membrane: NAFION 423;
(ii) Anode: expanded titanium, platinum/iridium coated;
(iii) Cathode: expanded titanium+lead; (iv) Current density: 30 A/dm$^2$.

The following media were circulated in the cell:
(a) Anolyte: 0.5 N $H_2SO_4$;
(b) Inlet catholyte: $Ti^{4+}$120 g/l; $Fe^{2+}$45 g/l; $^{3+}$1 g/l; $H_2SO_4$270 g/l.

With a speed of circulation of catholyte of 10 cm/s and a speed of circulation of anolyte of 0.5 cm/s, at a cell temperature of 65° C., a catholyte having the following composition was obtained at the outlet of the cathode compartment:

$Ti^{4+}$120 g/l; $Fe^{2+}$48 g/l; $Ti^{3+}$9 g/l.

The cathodic faradic yield was 90%.

While the invention has been described in terms of various preferred embodiments, the skilled artisan will appreciate that various modifications, substitutions, omissions, and changes may be made without departing from the spirit thereof. Accordingly, it is intended that the scope of the present invention be limited solely by the scope of the following claims, including equivalents thereof.

What is claimed is:

1. An electrolytic cell adapted for the reduction of a solution containing titanium and ferric ions, comprising an anode compartment, a cathode compartment, a cationic exchange membrane separating said anode and cathode compartments and means for circulating said solution containing titanium and ferric ions in said cathode compartment, wherein said ferric ions are reduced to ferrous ions in said cathode compartment.

2. The electrolytic cell as defined by claim 1, said cathode compartment comprising a copper-based cathode.

3. The electrolytic cell as defined by claim 1, said cathode compartment comprising a cathode based on at least one lead, titanium or specialty steel material.

4. The electrolytic cell as defined by claim 3, said cathode comprising lead deposited onto a support substrate.

5. The electrolytic cell as defined by claim 4, said cathode comprising lead deposited on titanium or copper.

6. The electrolytic cell as defined by claim 3, said cathode comprising titanium coated with at least one precious metal.

7. A process for the electrolytic reduction of a solution containing both titanium and ferric ions, comprising electrolyzing the solution while the solution is circulating in the cathode compartment of an electrolytic cell as defined by claim 1 wherein the electrolytic cell operates at a current density of at least 10 A/dm$^2$.

8. The process as defined by claim 7, said solution emanating from the sulfuric acidulation of a titanium bearing mineral.

9. The process as defined by claim 8, said titanium bearing mineral comprising ilmenite.

10. The process as defined by claim 7, wherein acidified water or a solution of ferrous salts is circulating in said anode compartment.

11. The process as defined by claim 7, comprising circulating said solution in said cathode compartment immediately prior to a hydrolysis stage in a process for the preparation of titanium hydroxide.

12. The process as defined by claim 7, further comprising recirculating the said solution in said cathode compartment.

13. The process as defined by claim 7, comprising circulating the said solution in the cathode compartment of at least two cells mounted in parallel.

14. The process as defined by claim 13, comprising separation said solution into a first and a second part, circulating said second part through the cathode compartment of said electrolytic cell, storing the second part of the solution treated in the cathode compartment in a reservoir compartment, and combining the stored solution with said first part solution which has bypassed the reduction process.

15. The process as defined by claim 14, wherein at least part of the solution issuing from said reservoir compartment is recycled into the cathode compartment of said cell.

16. The process as defined by claim 14, wherein the second part of said solution is circulated in the cathode compartments of two cells mounted in parallel.

17. The electrolytic cell as defined by claim 1, comprising a strongly acidic cationic exchange membrane.

18. The electrolytic cell as defined by claim 17, comprising a sulfonic acid cationic exchange membrane.

* * * * *